United States Patent [19]

Ototani

[11] 4,094,666

[45] June 13, 1978

[54] METHOD FOR REFINING MOLTEN IRON AND STEELS

[75] Inventor: Tohei Ototani, Tokyo, Japan

[73] Assignee: Metal Research Corporation, Tokyo, Japan

[21] Appl. No.: 800,140

[22] Filed: May 24, 1977

[51] Int. Cl.[2] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,634,075 | 1/1972 | Hoff | 75/53 |
| 3,729,309 | 4/1973 | Kawawa | 75/53 |
| 3,738,827 | 6/1973 | Pryor | 75/53 |
| 3,768,999 | 10/1973 | Ohkubs | 75/53 |
| 4,035,892 | 7/1977 | Ototani | 75/58 |

*Primary Examiner*—P. D. Rosenberg

*Attorney, Agent, or Firm*—Sughrue Rothwell, Mion, Zinn and Macpeak

[57] ABSTRACT

A molten iron and steel is refined by feeding a compressed and deformed composite clad obtained by cladding a core material of at least one of metallic calcium, metallic magnesium, calcium base alloys and magnesium base alloys with a sheath of iron, into the molten iron and steel at a feeding rate of 20–500 m/min. while deoxidizing, desulfurizing and spherodizing of graphite are effectively carried out.

5 Claims, 3 Drawing Figures

METHOD FOR REFINING MOLTEN IRON AND STEELS

The present invention relates to a method for refining molten iron, steel, nickel alloy or chromium alloy (referred to as iron and steels hereinafter) by adding a compressed and deformed composite clad containing deoxidizing agent or desulfurizing agent, more particularly to a method for refining molten iron and steels by adding the composite clads containing calcium, calcium base alloys, magnesium or magnesium base alloys having a low vaporizing temperature as the core at a high feeding rate.

The inventor has already disclosed the clad for adding calcium to be used for molten iron and steels in Japanese Patent Application No. 1615-73 (laid open Application No. 89618-74, referred to as reference A hereinafter) and the clad for adding magnesium or cerium to be used for molten iron and steels in Japanese Patent Application No. 386-73 (laid open Application No. 8750-74, referred to as reference B hereinafter).

The molten iron and steels to which these clads are applied, include molten iron, molten steel or molten nickel, nickel alloys, chromium, or chromium alloys, for example 13 chromium steel, gray pig iron, permalloy, 18-8 chromium nickel steel, hyper-eutectoid common carbon steel, electrolyzed iron, nodular pig iron, Ni-Cr low alloy steel, ferrite type stainless steel containing 30% of Cr and 2% of Mo, 25 Cr-20 Ni stainless steel and the like.

The core material in the above reference A comprises (a) a deoxidizing agent of calcium or calcium base alloy powder, (b) additive powder of at least one of aluminum, magnesium, strontium, barium, lithium and rare earth metals and (c) flux powder of at least one of silicates, oxides and halides of alkaline earth metals.

The core material of the above reference B comprises either of magnesium, rare earth metals or alloys containing these elements.

On the other hand, the sheath material to cover these cores is a tube of iron, aluminum or alloys of these metals.

The weight ratio of the core material to the clad in the above two references is 10–90%.

Furthermore, the inventor has found the composite clads to be added for refining iron steels and filed as Japanese Patent Application No. 34729-75 (laid open Application No. 109209-76, referred to as reference C). The core material of the composite clad in this reference C comprises at least one of calcium, calcium base alloys, magnesium and magnesium base alloys and at least one of oxides and halides of rare earth metals as the essential components or the core material is one obtained by adding at least one of oxides, halides and carbides of at least one of alkali metals and alkaline earth metals to the above described essential components.

The sheath material in this reference C is iron, aluminum or alloys of these metals and the weight ratio of the core material to the clad is 10–90%

The inventor has made futher study and found that the above described references A and B have the following demerits to be improved and obtained novel knowledge relating to these improvements and accomplished the present invention.

The above points to be improved are as follows.

(1) When aluminum is used as the sheath material, the melting point of aluminum is about 660° C, so that even if the composite clad is added to the molten iron and steels at any high feeding rate, the melting of the clad is more fast than that of the clad in which the sheath is composed of iron and it cannot be avoided that the reaction effect of the core material lowers. In addition, aluminum is higher in cost than iron, therefore it is disadvantageous to use aluminum as the sheath material.

(2) The core material in the above reference A contains calcium or calcium alloy as the main component and further the other metal powders which can contribute to deoxidation and desulfurization reactions, and the flux powder of silicates, oxides or halides of alkaline earth metals as the essential subcomponents.

Among the above described subcomponents, aluminum, magnesium, strontium, barium, lithium or rare earth metal powders are the elements having deoxidizing, denitrifying or desulfurizing ability and the powders of silicates, oxides or halides of alkaline earth metals are the flux, which has heat insulating function by which the raising temperature of the core material can be controlled to a certain degree until the sheath material melts in the molten iron and steels, or has desulfurizing or deoxidizing ability. However, it has been found that if the core material containing such subcomponents is used, the subcomponents sometimes are alloyed in the iron and steels and deteriorate the properties of the iron and steels, or the subcomponents increase the non-metal inclusion and further the storage and maintenance of such a composite clad must be made carefully, because the variation with the passage of time occurs due to the hygroscopicity of the composite clad.

An object of the present invention is to provide a method for refining the molten iron and steels by using the composite clads in which the drawbacks of the above described references invented by the inventor are improved.

The present invention consists in a method for refining molten iron and steel bath comprising;

feeding compressed and deformed composite clad material in wire and rod form having a sufficient rigidity obtained by clading a solidified core consisting essentially of at least one element of metallic calcium, metallic magnesium, calcium base alloys and magnesium base alloys, with a sheath of iron and mechanically compressing and deforming the resulting clad, into the molten iron and steel bath at a feeding rate of 20–500 m/min. without forming a fume or a flame of calcium or magnesium, whereby substantially 100% of the added calcium or magnesium is effectively reacted with molten iron and steel bath, while deoxidizing, desulfurizing, spherodizing of graphite and inoculating said molten iron and steel bath are effectively carried out.

Then, the present invention will be explained in more detail.

The composite clads to be used in the present invention includes the following four kinds, that is;

(1) A core material of metallic calcium or calcium base alloys is claded with an iron sheath and the resulting clad is mechanically compressed and deformed into a wire or rod form having a sufficient rigidity.

(2) Instead of the core material in the clad (1), the core material composed of magnesium or magnesium base alloys is used.

(3) Instead of the core material in the clad (1), the core material composed of calcium base alloys or magnesium base alloys are used.

(4) Instead of the core material in the clad (1), use is made of a mixture of at least one of metallic calcium, metallic magnesium, calcium base alloys and magnesium base alloys with at least one of oxides, silicides and halides of rare earth metals and alkali metals and silicates, oxides, halides and carbides of alkaline earth metals as the core material.

In this case, the addition amount of at least one of the oxides, silicides and halides of rare earth metals and alkali metals and silicates, oxides, halides and carbides of alkaline earth metals in less than 50% by weight based on the core material.

In the above described reference B, there is disclosed that rare earth metals are used as the core material and as the rare earth metals, Misch metal is broadly used. However, the oxides, silicides and halides of rare earth metals can be obtained far more cheaply than Misch metal. The oxides and/or halides of rare earth metals can be obtained by flotating pulverized bastnaesite, effecting simple extraction and roasting and these substances promote the deoxidizing, desulfurizing and spherodizing ability of calcium, calcium base alloys, magnesium and magnesium base alloys.

The flux of the above described oxides, halides or carbide of alkali or alkali earth metals, itself has a certain degree of deoxidizing ability or desulfurizing ability.

As the calcium base alloys capable of being used as the core material, mention may be made of Ca-Mg, Ca-Si, Ca-Si-Mn, Ca-Ba-Si, Ca-Ba-Si-Al, Ca-Fe-Si or the calcium base alloy consisting of said metals and the rare earth metals.

As the magnesium base alloys capable of being used as the core material, mention may be made of Mg-Ca, Mg-Si, Mg-Si-Mn, Mg-Ba-Si, Mg-Ba-Si-Al, Mg-Fe-Si or the magnesium base alloy consisting of said metals and the rare earth metals.

The weight ratio of the core material to the clad is 10–90% When this ratio is less than 10%, the amount of the core material added is too small and the effect of deoxidation and desulfurization cannot be expected, while when this ratio becomes larger than 90%, the wall thickness of the sheath material becomes too thin and even if the feeding rate of the composite clad into the molten iron and steels is made fast at any rate, the clad is melted and vaporized immediately when the clad contacts with the molten iron and steels, so that the cladding has no significance and therefore such an amount is not economic.

By using calcium, calcium base alloys, magnesium or magnesium base alloys in the present invention, the properties of the iron steels are not deteriorated different from the use of the clad using the core as in the above described reference A and the composite clad can be broadly used for any kind of molten iron and steels and the variation of the properties of the clad with passage of time due to moisture is small and the maintenance and the handling are easy and furthermore CaO or MgO which is the deoxidation product of calcium or magnesium, is apt to float up on the surface of the molten iron and steels, so that non-metallic inclusion is few.

An explanation will be made with respect to one embodiment for producing the composite clad of the present invention. The above described core material is covered with a hoop of a thin steel sheet having a given size by Arcos type machine for producing welding rod and the assembly is mechanically compressed and deformed to provide a sufficient rigidity, whereby the composite clad in wire and rod form is produced.

According to the present invention, the feeding rate of the composite clad wherein iron is the sheath material, is made to be very high and calcium and magnesium in the core material are permitted to reach the deep portion below the surface of the melt before the core material does not reach the vaporizing temperature in the melt. By such a means, the pressure of the melt bath is made to approach to the vaporizing pressure of the core material as far as possible or to be higher than the vaporizing pressure, whereby the vaporization of the core material is possibly prevented and the core material is held as much as possible in the melt, so as to contribute to refine the melt.

For example, when the composite clad containing calcium as the core material is fed into the molten iron or steel at 1,600° C, the vaporizing pressure of calcium is about 1.6 atm., while the sum of the bath pressure and atmospheric pressure at the position where is about 7 mm below the surface of the molten iron or steel is about 1.6 atm. and is substantially same as the vaporizing pressure of calcium. Therefore, when the feeding rate of the composite clad is made to be fast and before the temperature of the core material does not reach 1,480° C at which calcium begins vaporization, the core material reaches at the position where is 750 mm below the surface of the molten iron or steel, the amount of calcium vaporized is very small.

When the composite clad containing magnesium as the core material is fed into the molten iron or steel, the vaporizing pressure of magnesium is very high as $10^3$ mmHg even at 1,000° C, so that it is more difficult than calcium to effectively feed magnesium into the molten iron or steel, but on the other hand, magnesium shows a noticeable degassing effect upon melting because of the high vaporizing pressure. Accordingly, even if magnesium is vaporized violently and is consumed by oxidation, if the vaporization occurs at the deep portion below the surface of the molten iron or steel, the refining effect of degassing, desulfurization or spherodizing due to magnesium becomes large. Accordingly, the composite clad, the core of which is magnesium must make the feeding rate more fast than the composite clad, the core of which is calcium.

When the above described feeding rate is lower than 20 m/min. in the present invention, the sheath made of steel melts before the composite clad reaches the deep portion of the molten iron or steel and as soon as the sheath is molten, the vaporization of calcium or magnesium occurs violently and the refining effect becomes poor. While, for making the feeding rate higher than 500 m/min., a high cost is needed for production of the feeding apparatus and further the refining effect is not more improved, so that the feeding rate must be within a range of 20–500 m/min. However, the higher the feeding rate, the larger the advantage is and the most preferable results can be obtained at the feeding rate of more than 50 m/min.

According to the present invention, it is possible to refine the molten iron and steels by adding the composite clad to the molten iron and steels in Heroult arc furnace, electric induction furnace, ladle or continuous casting Turndish.

Furthermore, when the composite clad is added into the molten iron and steels, if the surface of the molten iron and steels is covered with a molten flux composed of at least one of silicates, oxides and halides of alkali metals, alkaline earth metals and rare earth metals, after which the composite clad is added to the molten iron and steels, the oxidation of the sulfides in the refined product, that is CaS or MgS owing to air is prevented and the resulfurization into the molten iron and steels is advantageously prevented.

In other words, when the molten iron and steels are not covered with the above described molten flux, the formed CaS or MgS contacts with air at the surface of the molten iron and steels and the reaction of the following formula (1) or (2) occurs.

$$2\,CaS + O^2 \rightarrow 2\,CaO + 2\,S \quad (1)$$

$$2\,MgS + O^2 \rightarrow 2\,MgO + 2\,S \quad (2)$$

The free sulfur formed by the above formula (1) or (2) again reacts with the molten iron and steels to form FeS, NiS and the like, which enter into the molten iron and steels and the resulfurization occurs.

On the other hand, when the molten iron and steels are covered with the molten flux, the desulfurized product of CaS or MgS is integrated in the molten flux and the resulfurization does not occur and the vapor of calcium or magnesium, which elevates to the boundary between the molten iron and steels and the molten flux which are formed from the added clad because this vapor does not react with the molten iron and steels is shieled with the molten flux and again reacts advantageously with the molten iron and steels. Furthermore, the molten flux prevents the molten iron and steels from cooling. Accordingly, the use of the above described molten flux is advantageous.

Then, an explanation will be made with respect to an apparatus for feeding the composite clad to be used in the present invention.

FIG. 1 shows said apparatus and a ladle.

A composite clad wire 4 is fed into a molten steel 6 in a ladle 5 through a pinch roller 2, which is provided to a stepless speed change device, and a guide tube 3 from a reel 1 wound with the clad wire. 7 shows a molten flux.

For a better understanding of the invention, reference is taken to the accompanying drawings, wherein.

EXAMPLE 1

Figure 1:
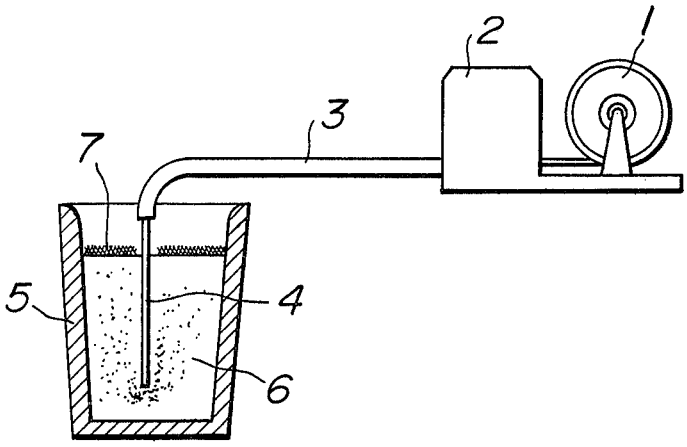
FIG. 1 shows an apparatus for feeding the clad wire for effecting the method of the present invention.

Chromium-molybdenum steel (composition: C: 0.19%, Si: 0.68%, Mn: 0.75%, P: 0.014%, Cr: 1.31%, Mo: 0.64%, remainder: Fe) was molten in Heroult arc furnace and the molten steel was charged in a ladle. The molten steel in the ladle was covered with a flux and then the composite clads having the same diameter of 4.8 mm of the core material, in which calcium core was covered with steel sheath and which were obtained by using Arcos type machine for producing welding rod, were added thereto at feeding rates of 90 m/in. and 15 m/min. respectively by means of an apparatus for feeding the composite clad. In this case, an amount of the core material in the clad added based on the molten steel was 0.5%. An amount of the molten steel using the feeding speed of 90 m/min. was about 12 tons and an amount of the molten steel using the feeding speed of 15 m/min. was 2 tons. The feeding time was 1.5 minutes in both the cases. After effecting these treatments, the oxygen content and the sulfur content in the ingots obtained by molding are shown in the following Table 1.

Table 1

| Amount of molten steel (ton) | Feeding rate (m/min.) | Feeding time (min) | Weight ratio of core material added based on molten steel % | $O_2$ % | S % |
|---|---|---|---|---|---|
| 12 | 90 | 1.5 | 0.5 | 0.011 | 0.007 |
| 2 | 15 | 1.5 | 0.5 | 0.019 | 0.010 |

As seen from the above Table 1, even if the core material is added in the same weight ratio, when the feeding rate is higher, the refining effect is better.

EXAMPLE 2

1 ton of molten steel obtained by melting nickel alloy (composition: Ni: 79.2%, remainder: Fe) by high frequency was charged in each amount of 500 kg in two ladles respectively. The molten steel in the ladle was covered with a flux. The composite clads having a cross-sectional area of the core material being about 20 $mm^2$ (diameter of the core material: 5 mm) and a cross-sectional area of the core material being about 10 $mm^2$ (diameter of the core material: 3.5 mm), in which the core material was the same as used in Example 1 and which were produced by Arcos type machine for producing welding rod, were added to the molten steels in feeding rates of 15 m/min. and 30 m/min. for ⅓minute respectively. In this case, the ratios of the amounts of the core material substantially added, based on the molten steels were 0.3% respectively. After effecting these treatments, the oxygen content and the sulfur content in the nickel alloy steel ingots obtained by molding are shown in the following Table 2.

Table 2

| Amount of molten steel (ton) | Feeding rate (m/min.) | Feeding time (min) | Weight ratio of core material added based on molten steel % | $O_2$ % | S % |
|---|---|---|---|---|---|
| 0.5 | 30 | ⅓ | 0.3 | 0.029 | 0.008 |
| 0.5 | 15 | ⅓ | 0.3 | 0.038 | 0.010 |

This Example shows that when the core material having the same weight ratio based on the molten steel is added to the molten steels having the same weight in the same time, the refining efficiency is more excellent when the feeding speed is 30 m/min. and is more fast.

EXAMPLE 3

6 tons and 12 tons of molten steels of chromium alloy (composition: Cr: 12%, C: 0.14%, Si: 0.39%, Mn: 0.70%, P: 0.018%) molten in Héroult arc furnace were charged into two ladles respectively and the molten steels were covered with a flux. The composite clads having the same core material as used in Example 1, the cross-sectional area of the core material being about 10 $mm^2$ (diameter of core material: 3.5 mm), which were produced by using Arcos type machine for producing welding rod, were added in a feeding rate of 50 m/min. to 6 tons of molten steel for 1.5 minutes and to 12 tons of molten steel for 3.0 minutes respectively. In this case, the ratios of the amount of the core material substantially added, based on the molten steels were 0.37% respectively. After effecting these treatments, the oxygen content and the sulfur content in the steel ingots obtained by molding are shown in the following Table 3.

Table 3

| Amount of molten steel (ton) | Feeding rate (m/min.) | Feeding time (min.) | Weight ratio of core material added based on molten steel % | $O_2$ % | S % |
|---|---|---|---|---|---|
| 6 | 50 | 1.5 | 0.37 | 0.0062 | 0.007 |
| 12 | 50 | 3.0 | 0.37 | 0.0055 | 0.006 |

This Example shows that when the feeding rate is same and the core material is fed in the same weight ratio, substantially the same refining effect is obtained.

EXAMPLE 4

Figure 2:
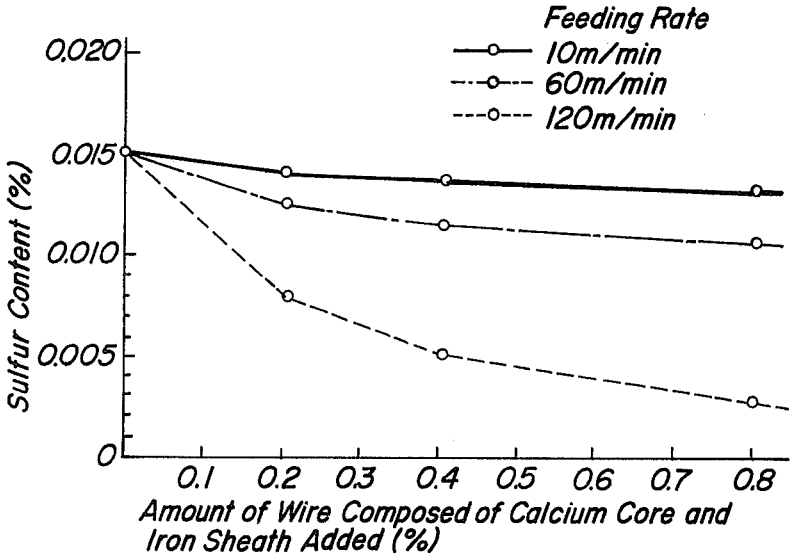
FIG. 2 shows the desulfurizing curve obtained by using the clad wire wherein a calcium core is covered with an iron sheath.

Each of 500 kg of 17-4PH stainless steel was molten in a high frequency induction electric furnace. After molten out, the composite clads having calcium core and steel sheath and having a diameter of 4.8 mm, which were produced by using Arcos type machine for producing welding rod, were added to the molten steels in feeding rates of 120 m/min., 60 m/min. and 10 m/min. respectively. In this case, the composite clads were added for such times that the amounts of calcium core added, based on the molten steels became 0.8%, 0.4% and 0.3% respectively. The sulfur content in the molten steels is shown in FIG. 2. As seen from FIG. 2, even if the added amount is same, when the feeding rate is higher, the desulfurization is effected more effectively.

EXAMPLE 5

A composite clad having an outer diameter of 3.2 mmϕ was produced from a sheath material of a soft steel hoop having a thickness of 0.25 mm and a width of 35 mm and a core material of a mixture of 20% of metallic calcium of less than 8 meshes and 5% of bastnaesite having less than 20 meshes obtained by extraction with a solvent and then roasting at 750° C, by means of Arcos type machine for producing welding rod. This clad was added to 5 tons of the following melts in the ladle at a feeding rate of 90 m/min. in an amount of the core material being 0.5% based on the melt by means of a feeding apparatus and the sulfur content and the impact value at a low temperature before and after the addition were compared to obtain the results as shown in the following Table 4. Furthermore, the impact values at a low temperature after the addition were considerably improved as compared with 2 kg m/cm$^2$ of the conventional product and the anisotropy was also improved.

Table 4

| Melt No. | Chemical component C | Si | Mn | P | Cr | Mo | Before addition S | After addition S | Impact value after addition (average value) −60° C, kg·m/cm$^2$ |
|---|---|---|---|---|---|---|---|---|---|
| 199 | 0.17 | 0.68 | 0.75 | 0.014 | 1.31 | 0.48 | 0.018 | 0.009 | 4.0 |
| 202 | 0.15 | 0.66 | 0.78 | 0.022 | 1.64 | 0.64 | 0.015 | 0.010 | 3.2 |
| 205 | 0.16 | 0.71 | 0.81 | 0.024 | 1.50 | 0.62 | 0.020 | 0.010 | 3.5 |

EXAMPLE 6

A composite clad (A clad in Table 5) having an outer diameter of 4.8 mmϕ, was produced from a sheath material of a soft steel hoop having a thickness of 0.3 mm and a core material of a mixture of 20% of magnesium powder of 15 meshes and 10% of bastnaesite obtained by extraction with a solvent and roasting at 800° C, by means of a rolling machine for producing wire. This clad was added to molten cast iron at 1,450° C at a feeding rate of 50 m/min. in an amount of the core material being 1.0% based on the molten cast iron.

Another core material was prepared by adding to the above described core material a flux ($MgCl_2$ 80%, $CaC_2$ 20%) corresponding to 10% of the weight of the above described core material and another composite clad (B clad in Table 5) was produced in the same manner as described above. This clad B was added to the molten cast iron under the same condition as in the clad A. However, the added amount was 1.1%.

The spherodized graphite cast iron after the addition showed the mechanical properties as described in the following Table 5 in the cast state.

Table 5

| | Tensile strength kg/mm$^2$ | Elongation % |
|---|---|---|
| Clad A | 69.2 | 6.8 |
| Clad B | 71.5 | 7.1 |

As seen from the above Table 5, in the clad B, the core material of which contains the flux, the tensile strength and elongation are improved even in a very slight value.

EXAMPLE 7

A composite clad having an outer diameter of 4.8 mmϕ was produced from a sheath material of a soft steel hoop having a thickness of 0.2 mm and a core material of a mixture of 10% of metallic calcium powder of 8 meshes, 5% of metallic magnesium powder of 15 meshes and 10% of bastnaesite obtained by extraction with a solvent and roasting at 700° C, by means of a rolling machine for producing wire.

Then, 830 kg of SC55 was molten in an arc furnace and this clad was added to this furnace at a feeding rate of 75 m/min. by means of a feeding apparatus in an amount of the core material being 0.5% based on the melt.

After deoxidation in the furnace, the oxygen content was varied as follows by lapse of time. Before addition, the amount was 0.009% and the amount in the ladle was 0.005% and the oxygen content was decreased and after centifugal casting, the content was considerably decreased to 0.0013%.

EXAMPLE 8

A composite clad having an outer diameter of 3.2 mmϕ was produced from a sheath of a soft steel hoop having a thickness of 0.3 mm and a core of a mixture of 35% of metallic calcium powder of 8 meshes and 15% of bastnaesite obtained by extraction with a solvent and roasting at 800° C by, means of a rolling machine for producing wire.

50 kg of molten stainless steel (Cr: 30%, Mo: 2%, remainder: Fe) containing original oxygen content of 0.046 and original sulfur content of 0.021 was obtained by means of a high frequency vacuum induction furnace and the above described clad was added to the said molten stainless steel in an amount of the core material being 0.2% and 0.4% based on the molten steel respectively.

Figure 3:
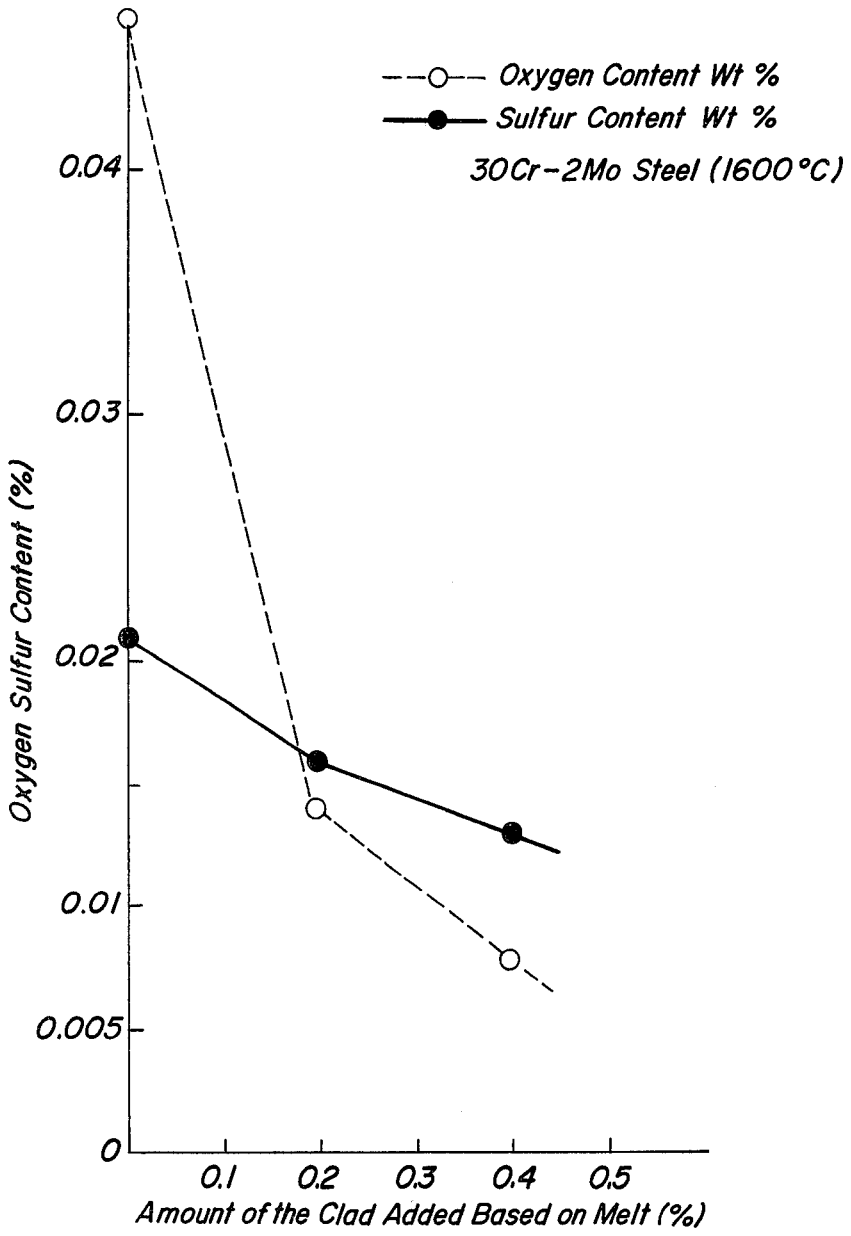
FIG. 3 shows a relation of the oxygen and sulfur contents in the molten stainless steel to the amount of the clad wire of the present invention added to the molten steel.

The oxygen content and the sulfur content after the addition are shown in FIG. 3. As seen from FIG. 3, the deoxidation and desulfurization proceed very effectively.

EXAMPLE 9

A molten steel having the composition of 3.45% of C, 1.5% of Si, 0.3% of Mn, 0.03% of P, 0.03% of S, and remainder being Fe for roll made of spherodized graphite cast iron was obtained in 20 tons reverberatory furnace. The above described molten steel was divided into two parts, each being 10 tons of molten steel.

To the first molten steel was added 100 kg of Fe-Si-Mg (Mg: 17.5%, Ce: 2.5%, Si: 55%, remainder: Fe) by the conventional plunge method. In the thus obtained product, the tensile strength was 55.3 kg/mm$^2$ and the elongation was 5.8 %.

To the second molten steel was added the clad wire having a diameter of 7 mm$\phi$ and containing 35% of CaSi, 7.5% of $MgF_2$, 2.5% of fluoride of rare earth metal and 5% of Mg as the core material at a feeding rate of 75 m/min. in an amount of 1% based on the molten steel. Upon the addition, generation of fume and flame was not observed and the product was completely spherodized and the tensile strength was 65.6 kg/mm$^2$ and the elongation was 7.5%.

When the core materials composed of Ca-Si-Mn, Ca-Ba-Si, Ca-Ba-Si-Al or Ca-Fe-Si was used instead of the above described core material were used, substantially the same results as in the above core material were obtained.

As mentioned above, by using the composite clads according to the present invention, molten iron and steels can be refined and iron and steels having excellent properties can be obtained.

What is claimed is:

1. A method for refining molten iron and steel bath comprising, feeding a compressed and deformed composite clad material of a solidified core encassed in a sheath in wire and rod form having a sufficient rigidity obtained by clading a core consisting essentially of at least one element of metallic calcium, metallic magnesium, calcium base alloys and magnesium base alloys, with a sheath of iron and mechanically compressing and deforming the resulting clad, into the molten iron and steel bath at a feeding rate of 20–500 m/min, a rate of feeding fast enough to avoid forming a fume or a flame of calcium or magnesium, whereby substantially 100% of the added calcium or magnesium is effectively reacted with said molten iron and steel bath, while deoxidizing, desulfurizing, spherodizing of graphite and inoculating said molten iron and steel bath are effectvely carried out.

2. The method as claimed in claim 1, wherein the core additionally contains at least one element of the group consisting of oxides, silicides and halides of rare earth metals and alkali metals, silicates, oxides, halides, and cabides of alkaline earth metals.

3. The method as claimed in claim 1, wherein an amount of the core based on the clad material is 10–90% by weight.

4. The method as claimed in claim 1, wherein the magnesium base alloy is Mg-Ca, Mg-Si, Mg-Si-Mn, Mg-Ba-Si, Mg-Ba-Si-Al, Mg-Fe-Si or the magnesium base alloy consisting of said metals and the rare earth metals.

5. The method as claimed in claim 1, wherein the calcium base alloy is Ca-Mg, Ca-Si, Ca-Si-Mn, Ca-Ba-Si, Ca-Ba-Si-Al, Ca-Fe-Si or the calcium base alloy consisting of said metals and the rare earth metals.

* * * * *